US005566736A

United States Patent [19]

Crider et al.

[11] Patent Number: 5,566,736

[45] Date of Patent: Oct. 22, 1996

[54] SEALABLE CURTAIN

[76] Inventors: Grant W. Crider, Rte. 1 Box 17, Bremen, Ala. 35033; Charles H. Harbison, 3217 Georgetown Pl., Birmingham, Ala. 35216

[21] Appl. No.: 556,484

[22] Filed: Nov. 13, 1995

[51] Int. Cl.[6] ..... E06B 9/08

[52] U.S. Cl. ..... 160/121.1; 160/85

[58] Field of Search ..... 160/85, 86, 120, 160/121.1, 122, 242, 266, 268.1, 270, 271, 273.1

[56] References Cited

U.S. PATENT DOCUMENTS

| | | | |
|---|---|---|---|
| 1,113,721 | 10/1914 | Watson . | |
| 1,309,488 | 7/1919 | Richardson . | |
| 2,349,368 | 5/1944 | Myers | 160/85 X |
| 3,789,904 | 2/1974 | Takazawa | 160/120 |
| 3,980,122 | 9/1976 | Takazawa | 160/120 X |
| 4,344,473 | 8/1982 | Shore | 160/121.1 |
| 4,344,474 | 8/1982 | Berman | 160/121.1 |
| 4,418,739 | 12/1983 | Woolnough et al. | 160/120 |
| 4,436,137 | 3/1984 | Charles | 160/268.1 X |
| 4,453,584 | 6/1984 | Steele | 160/121.1 |
| 4,649,981 | 3/1987 | Bibeau . | |
| 4,744,403 | 5/1988 | Hausmann et al. . | |
| 5,141,044 | 8/1992 | Hying et al. . | |
| 5,195,594 | 3/1993 | Allen et al. . | |

*Primary Examiner*—David M. Purol
*Attorney, Agent, or Firm*—Veal & Marsh

[57] ABSTRACT

A rollup closure utilizes a flexible cover or curtain selected from a material suitable to effect the type closure sought such as against light, ventilation, noise, sound or moisture. The cover is at least as wide as the opening to be covered and is longer than the opening is high. Each lateral margin of the cover has a strip of closure material affixed thereto, and a complimentary strip is affixed to the inside of a channel member. The top of the curtain is rigidly affixed across the top of the opening. The bottom of the curtain is upturned and connected to a driven take up roller mounted atop the opening. An elongated rod is supported within the upturned end of the curtain with its ends captured within the channels on each side of the opening. A weighting rod is supported atop the elongated rod and separated therefrom by the upturned end of the curtain, with the ends of the weighting rod also captured in the lateral channels. Activation of the driven roller lengthens or shortens the effective length of the curtain and moves the rods upwardly within the channels such that the mating closures are positioned to seal and unseal the curtain to the channel. Alternative embodiments may have multiple layers of curtain material or various sealing arrangements incorporated.

11 Claims, 4 Drawing Sheets

SEALABLE CURTAIN

FIELD OF THE INVENTION

The present invention relates to the field of closures for windows, doors, or portals and more particularly to closures which can be selectively positioned. In greater particularity the present invention relates to a non-sliding roll up closure for a portal.

BACKGROUND

Various applications are known wherein a portal requires a cover to prevent the passage of wind, rain, light, or anything else through the portal. As used herein portal simply means an opening which would allow the passage of such therethrough, hence a portal may be a window which is transparent to light and the cover of the instant in invention may control the passage of any of the above therethrough. Primarily, the genesis of the present invention resides in the need for large covers for large portals such as may be found on patios, pool houses, green houses, livestock houses, atriums or any other similar structure. The portal may be as small as would accommodate a ventilation fan in a gymnasium or livestock house or as large as an atrium wall in a solar efficient building. The cover may also be used for an inclined roof panel.

SUMMARY OF THE INVENTION

It is the principal object of the present invention to provide a means for effectively sealing large openings such as windows and doors in a number of differing types of buildings.

Another object of the invention is to provide a reliable and easily operated closure for such portals.

Still another object of the invention is to provide a closure which is relatively impervious to the accumulation of debris thereon.

These and other objects and advantages of our new closure are accomplished through the use of a novel combination of features in a roll up closure. The present closure utilizes a flexible cover or curtain selected from a material suitable to effect the type of closure sought. For example, if the closure is to allow ventilation, but obstruct light, the material of the curtain would be of a weave that would be permeable to air, but block a certain amount of light. Similarly, the closure could be pervious to moisture yet permeable to air, or vapor proof yet transparent, or opaque and vapor proof as the needs of the building on which the closure is used require. The cover is at least as wide as the opening to be covered and is longer than the opening is high. Each lateral margin of the cover has a strip of hook and pile fastener material affixed thereto, and a complimentary strip is affixed to the inside of a channel member. The top of the curtain is rigidly affixed across the top of the opening. The bottom of the curtain is upturned and connected to a driven take up roller mounted atop the opening. An elongated rod is supported within the upturned end of the curtain with it's end captured within the channels on each side of the opening. A weighting rod is supported atop the elongated rod and separated therefrom by the upturned end of the curtain, with the ends of the weighting rod also captured in the lateral channels. Activation of the driven roller lengthens or shortens the effective length of the curtain and moves the rods upwardly within the channels such that the mating hook and pile fasteners are positioned to seal and unseal the curtain to the channel. Alternative embodiments may have multiple layers of curtain material or various sealing means incorporated.

BRIEF DESCRIPTION OF THE DRAWINGS

Apparatus embodying features of our invention are depicted in the accompanying drawings which form a portion of this disclosure and wherein.

DESCRIPTION OF THE PREFERRED EMBODIMENT

Figure 1:
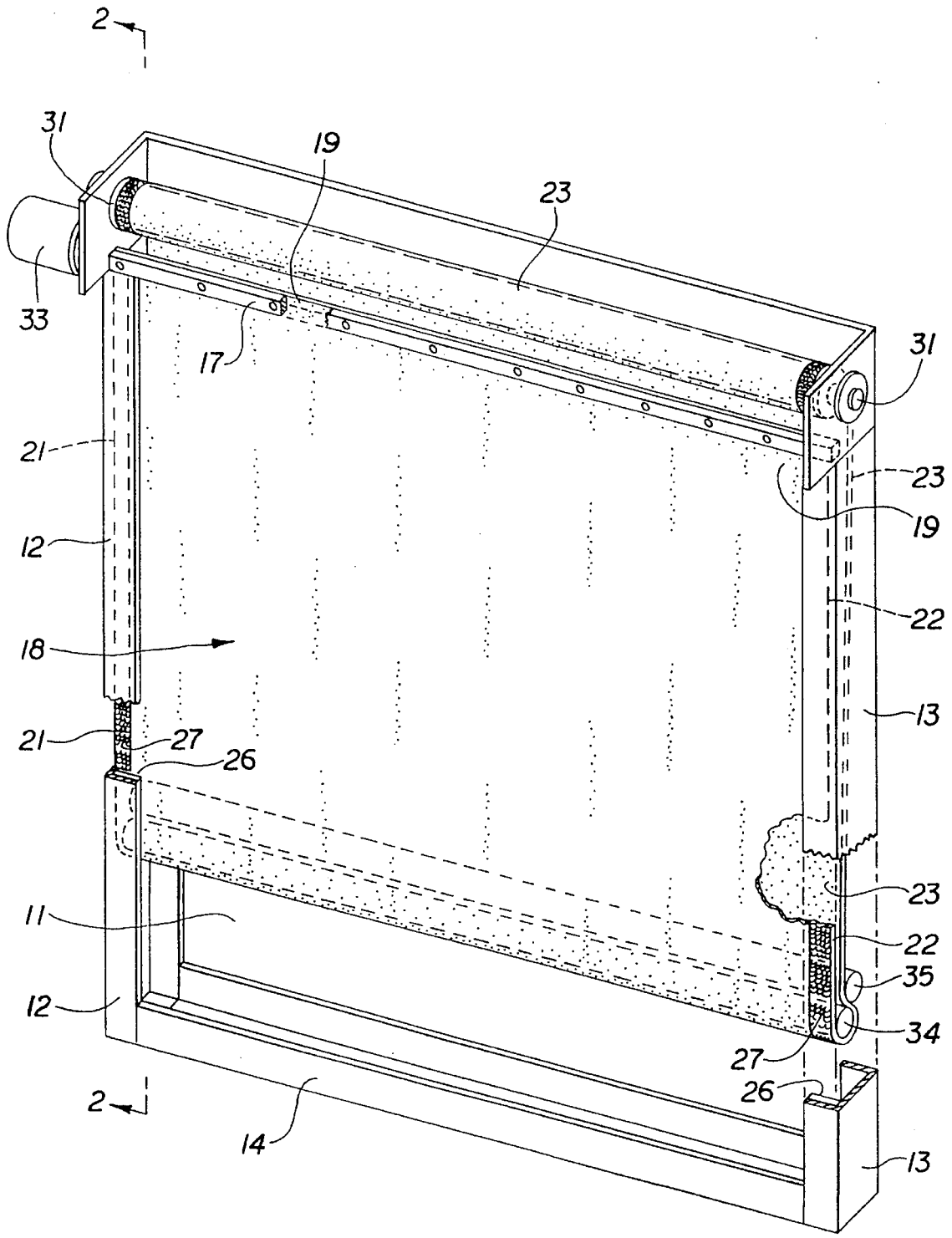
FIG. 1 is a front perspective view of the invention in a partially raised position and shown partially in section.
Figure 2:
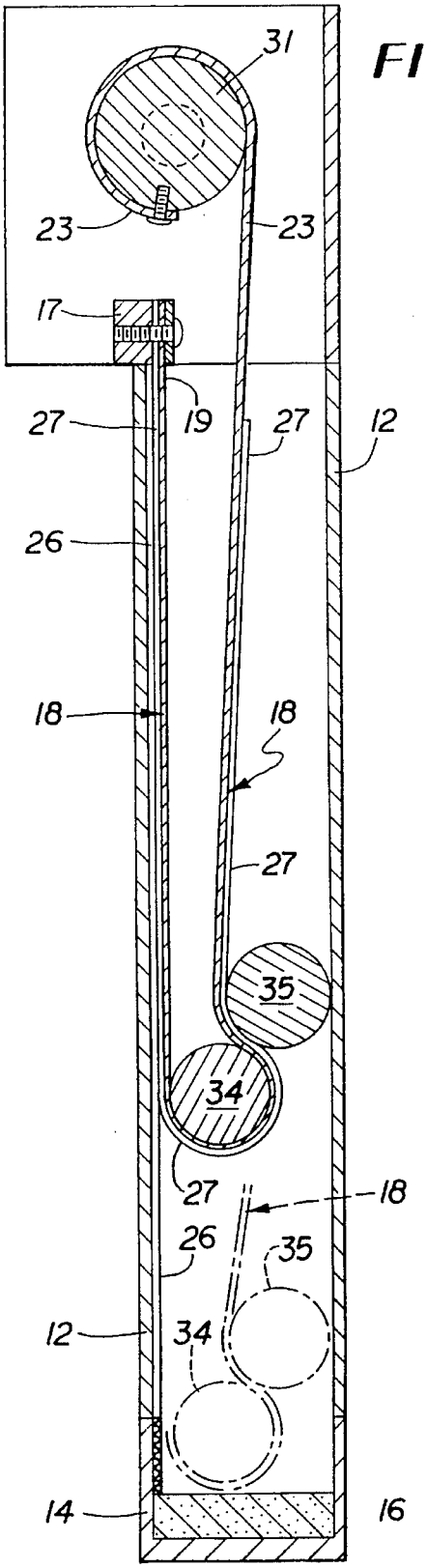
FIG. 2 is a sectional view of the invention taken along line 2—2 of FIG. 1.
Figure 3:
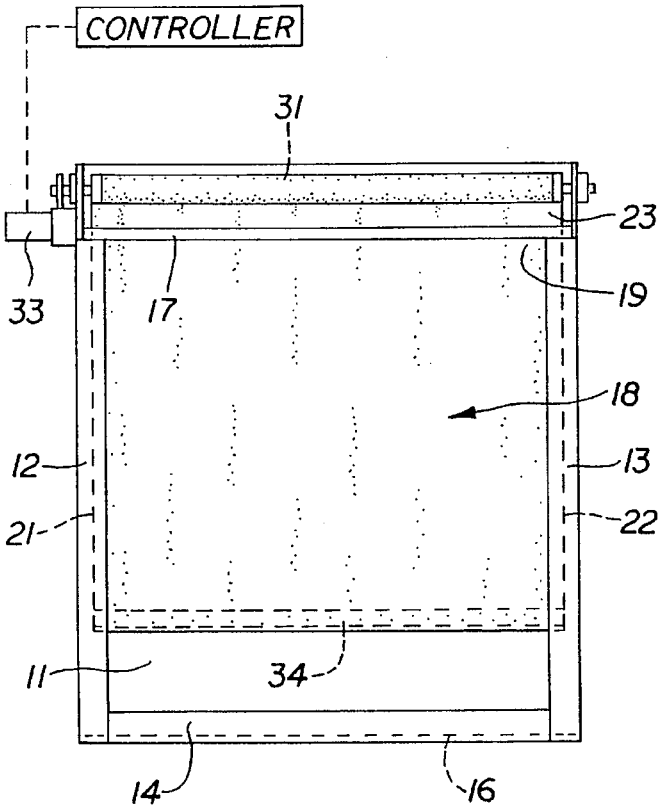
FIG. 3 is a frontal view of the invention.
Figure 4:
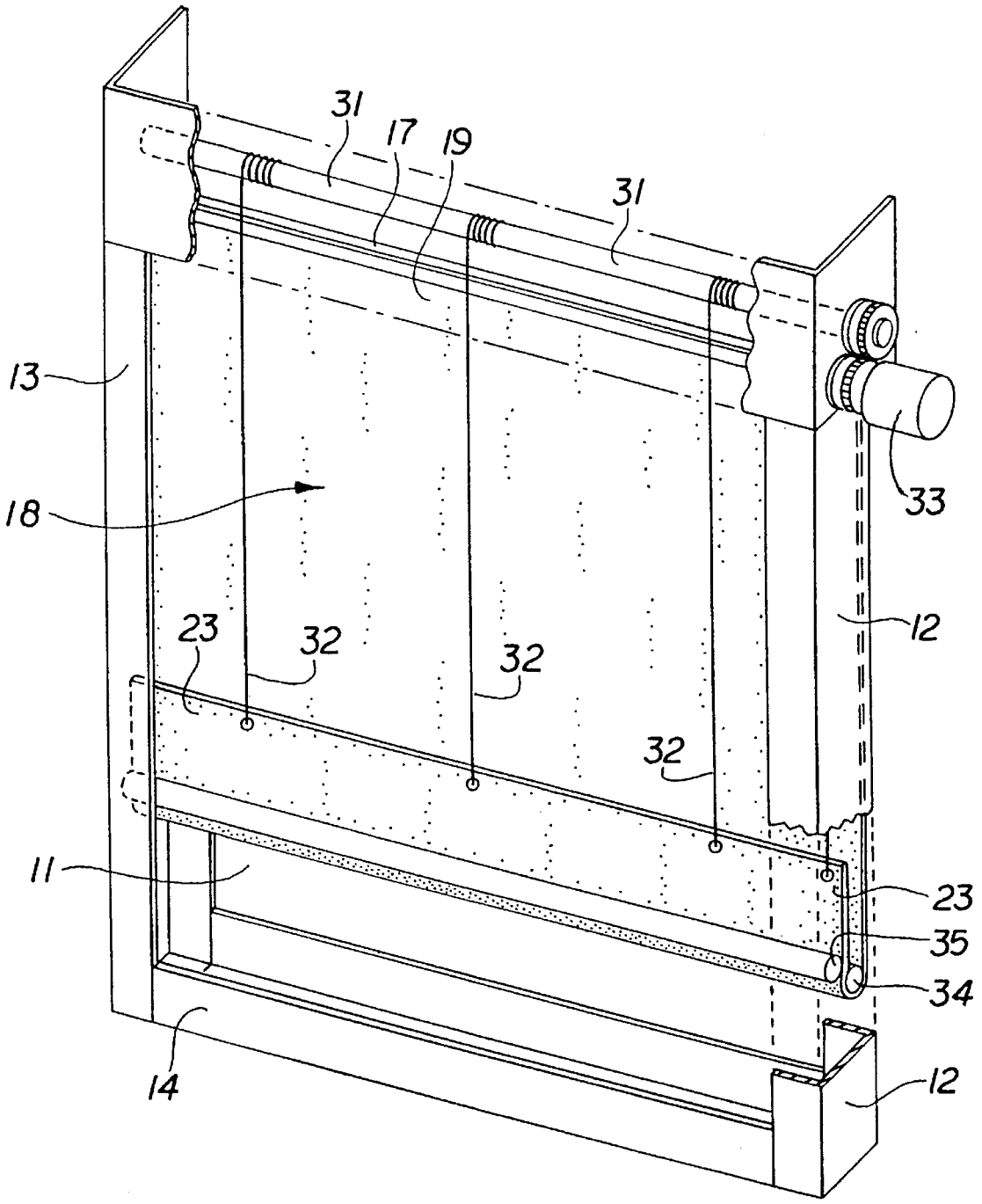
FIG. 4 is a rear perspective view of an alternate drive means.

Referring to the Drawings for a clearer understanding of the invention, it will be appreciated that our apparatus is usable with a variety of building types, and is usable to cover a variety of openings such as doors, sidewalks, roofs, windows, and skylights in such applications. Accordingly, the following description is intended to encompass any specific use to which the structure may be afforded. Referring to FIGS. 1 & 2, it may be seen that the opening 11 to be covered is provided with a pair of inwardly facing channel members 12 and 13, being C-shaped in the horizontal plane. Channel members 12 and 13 extend the full vertical length of the opening 11 and may terminate at a lower channel 14, which is upwardly opening and which extends across the width of the opening. In some applications a sealing gasket 16, such as a compressible layer of a foam like material will be useful in the bottom of lower channel 14. Across the top of opening 11 is a brace 17 which extends from channel 12 to channel 13. Thus, it may be seen that the opening is completely framed by members 12, 13, 14, and 17.

Attached to brace 17 is a first end of a curtain 18, which is a flexible material selected in accordance with the purposes of the present invention for its ability to block or transmit light, air, or moisture from one side to the other thereof. As an air barrier, we have noted that a woven polyester fabric has exhibited good durability having withstood over 60,000 cycles of operation of the invention. However, canvas, other plastics, some metals and fabrics which are selectively permeable are known to exist which may find application in the present invention. Therefore, curtain 18 is properly defined as a flexible barrier material, having a first end 19 secured to brace 17 and opposing longitudinal sides 21 and 22 which are longer than the length of channel members 12 and 13 such that the curtain 18 has an upturned lower end 23. Attached to channels 12 and 13 and to sides 21 and 22 are complementary closure members 26 and 27. For example, hook and loop fastener material was attached to the polyester fabric used in testing the invention and to the inside of channels 12 and 13 such that the sides 21 and 22 could be selectively attached and detached from the channels. Other means of fastening, such as magnetic strips may be used when appropriate to the particular application. Note that the closure members need only be commensurate in length with the length of the channels, thus the upturned end 23 of curtain 18 does not need the fastener material. A transverse closure may be provided in conjunction with lower channel 14; however, on a door, channel 14 would not be present.

The upturned end 23 may be directly connected to a transverse take-up spindle 31 mounted for rotation above the tops of channels 12 and 13. Alternatively, end 23 may be connected to the spindle 31 by cables 32 or straps, and the spindle may include a spool for such cables or straps. In any case, the spindle 31 is driven by a reversible motor 33 attached to a selected means of control and supports the upturned end 23. An elongated roller 34, which may be a solid or tubular pipe, is supported within the curve of the curtain 18 created by the upturned end 23 and has opposing ends which extend into the opposing channels 12 and 13 such that roller 34 can roll freely vertically in the channels, but cannot pivot in the horizontal plane about its mid point, thus as spindle 31 is rotated to wrap lower end 23 thereon roller 34 is lifted within channel 12 and 13 such that it rolls up the channel. A weighting roller 35 is captured at opposing ends within the channels 12 and 13 parallel to elongated roller 34. Weighting roller 35 is captured by the channels above roller 34 and is separated from roller 34 by the upturned end of curtain 18. Thus, as splindle 31 rotates rollers 34 and 35 are constrained to rotate in opposite direction with the upturned end of flexible curtain 18 passing between the rollers. As splindle 31 unwraps the curtain or straps from itself, gravity urges the rollers and curtain to a lowered position.

It will be appreciated that channels 12 and 13 are wider than the diameter of rollers 34 and 35 such that roller 35 is supported in offset vertical relation to roller 34, therefore, a lateral component of the weight of the rollers is applied to the channel members. Accordingly, the sides of the curtain 21 and 22 carrying the closure 27 are pressed by this component of force against the complimentary closure 26 of the channel, thereby ensuring a sealing connection. It will be appreciated that the downward force of gravity due to the weight of the roller and the lateral force component generated by the offset position of the rollers keeps the curtain fabric taut at all times such that the sealing members are properly engaged, thus insuring proper tensioning of the curtain. As spindle 31 raises the end of the curtain and the rollers, the lifting force is transferred around roller 34 to provide an opening force to the closures nearly normal thereto, such that they are readily detached. From the forgoing it is easily seen that as spindle 31 rotates, it effectively varies the length of the curtain 18 such that rollers 34 and 35 urge the closure member into sealing the engagement above themselves.

Figure 5:
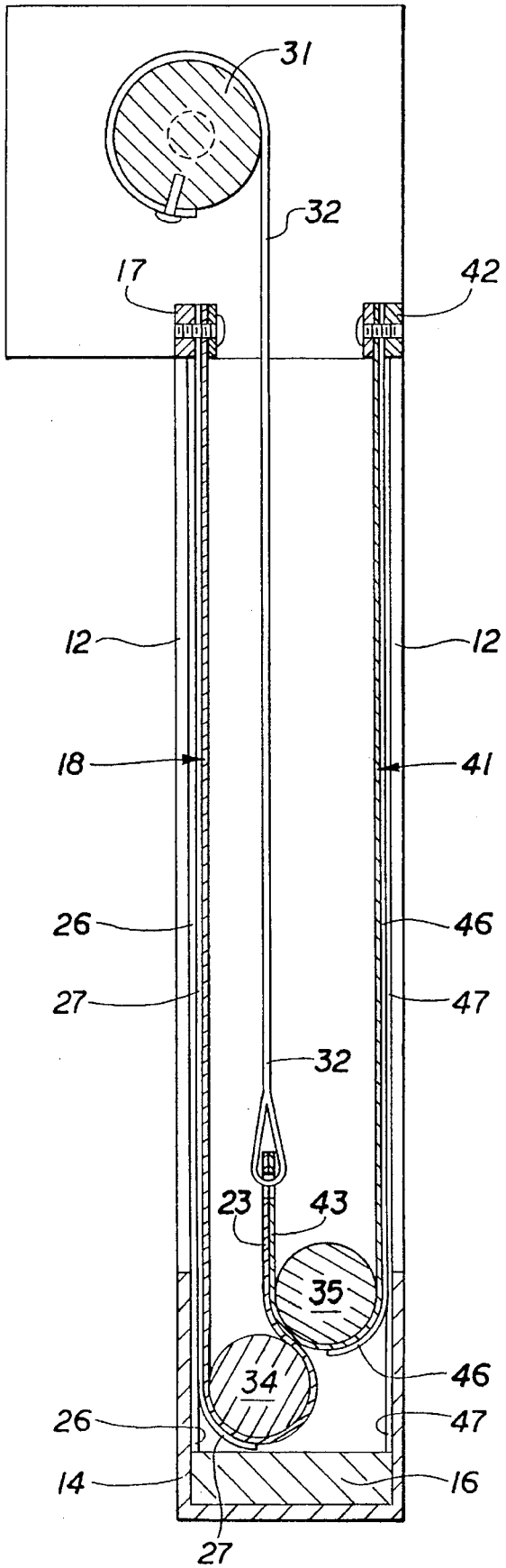
FIG. 5 is a sectional, view of an alternative embodiment using multiple curtain layers.

In an alternative embodiment shown in FIG. 5, a second curtain 41 is provided and is attached to a second brace 42. Second curtain 41 has the same structure as curtain 18 and has an upturned end 43 which passes beneath roller 35, but not roller 34. Upturned ends 43 and 23 are attached such that they are commonly supported by splindle 31, and move concomitantly vertically between braces 14 and 42. It will be appreciated that the closure members 46 carried by curtain 41 mate with closure members 47 mounted on the channels 12 and 13 to provide a double sealed barrier.

The control mechanism may be any of a number of mechanisms depending on the needs of the application of the invention. For example, in a livestock confinement house where temperature control is a necessity, the present invention may be used as a cover for a ventilation fan, and as a variable height curtain over a window. In this situation a temperature controller such as the type manufactured by the assignee of this application may be attached to each motor for each curtain and constantly monitor the temperature in the house. In this manner, the fans may be uncovered and actuated, and the curtain raised or lowered to meet specific airflow conditions. In another example, the present invention may be used in a greenhouse, having a need to control the amount of sunlight on certain plants during particular months. In this situation, the motor may be controlled by a timer or may be connected to a sensing system connected to a plurality of photocells that incrementally indicate to the motor how much of the curtain should be raised or lowered. Likewise, the opening can be monitored to close during a rain shower. In the simplest case a switch to turn the motor on and off may be provided. Furthermore, limit switches of various kinds may be placed at various locations to further control the movement of the curtain, such that it may eliminate air curtains or the like.

It is ostensibly noteworthy to mention that the present invention is not susceptible to sliding friction between pans all of mating surfaces contacting each other with a rolling relationship. Therefore, wear on the curtain is minimized, and the drive units do not have to overcome friction to position the curtain. Furthermore, the curtain is not susceptible to jamming due to debris being wedged into sliding engagement with a component since no sliding movement is provided. Accordingly, we have developed a rollup curtain system that is amenable to a variety of uses in numerous applications from residential to commercial to botanical to agricultural.

While I have shown my invention in various forms, it will be obvious to those skilled in the art that it is not so limited, but is susceptible of various changes and modifications without departing from the spirit thereof.

What I claim is:

1. Apparatus for opening and closing a portal in a structure comprising, in combination:

a) a pair of spaced apart opposing channel members defining the lateral margins of said portal;

b) a flexible curtain, having a length greater than the length of said lateral margins of said portal, elongated side portions, a first end and a second end each having a dimension commensurate with the separation of the channel members, with said first end being fixedly attached across said portal at an upper end thereof, said second end folded back on itself to define an upwardly opening pocket;

c) an elongated roller captured within said pocket, and having opposing ends captured within said opposing channel members;

d) a weighting roller supported on and separated from said elongated roller by said upturned end, and having opposing ends captured within said opposing channel members superjacent said elongated roller; and e) means for urging said upturned end along a vertical path such that said pocket is positioned at different heights.

2. Apparatus as defined in claim 1 further comprising means for releasably and repeatedly attaching said elongated side portions to said channel members concomitantly with positioning said pocket at different heights.

3. Apparatus as defined in claim 2 wherein said attaching means includes hook and loop fasteners cooperatively affixed to said elongate portions and said channel members.

4. Apparatus as defined in claim 1 wherein said means for urging comprises a driven roller mounted superjacent said portal cooperatively connected to said upturned end.

5. Apparatus as defined in claim 1 further comprising a second flexible curtain, having a length greater than the length of said lateral margins of said portal, elongated side portions, a rust end and a second end each having a dimension commensurate with the separation of the channel members, with said first end being fixedly attached across said portal at an upper end thereof, said second end folded back on itself to define a second pocket within which said weighting roller is captured with the second end of said second curtain, and the second end of said first curtain adapted for concomitant motion.

6. Apparatus as defined in claim 5 further comprising means for releasably and repeatedly attaching said elongated side portions of said first and second curtains to said channel members concomitantly with positioning said first and second pockets at a selected height.

7. Apparatus as defined in claim 6 wherein said means for urging comprises a driven roller mounted superjacent to said portal cooperatively connected to said upturned ends of said first and second curtains.

8. Apparatus as defined in claim 7 wherein said roller is connected to said upturned ends by a plurality of cables.

9. Apparatus for sealably covering and uncovering a portal comprising:

a) framing means for defining a pair of opposing guide tracks on opposite sides of said portal;

b) a pair of parallel rollers spanning said portal and having ends engaged within said guide tracks, said pair including an upper roller and a lower roller;

c) a flexible curtain spanning said portal and having a first end affixed to said framing means at a predetermined height relative to said portal, and a second end passing beneath said lower roller and between said lower roller and said upper roller to form an upwardly opening pocket; and, d) means operatively connected to said second end for varying the height of said pocket.

10. Apparatus as defined in claim 9 further comprising means for releasably and repeatedly attaching said flexible curtain to said framing means along elongated side portions of said curtain concomitantly with positioning said pocket at varying heights.

11. Apparatus as defined in claim 10 further comprising a second flexible curtain, having a length greater than the length of said portal, elongated side portions, a first end and a second end each having a dimension commensurate with the separation of the guide tracks, with said first end being fixedly attached across said portal at an upper end thereof, said second end folded back on itself to define a second pocket within which said upper roller is captured with the second end of said second curtain and the second end of said first curtain adapted for concomitant motion.

* * * * *

UNITED STATES PATENT AND TRADEMARK OFFICE

CERTIFICATE OF CORRECTION

PATENT NO. : 5,566,736

DATED : October 22, 1996

INVENTOR(S) : Grant W. Crider; Charles H. Harbison

It is certified that error appears in the above-identified patent and that said Letters Patent is hereby corrected as shown below:

Column 5, claim 5, line 4, change "rust" to --first--.

In Claim 5, change "rust" to "first".

Signed and Sealed this

Twenty-first Day of January, 1997

*Attest:*

*Attesting Officer*

BRUCE LEHMAN

*Commissioner of Patents and Trademarks*